US007503391B2

(12) United States Patent
McCanna et al.

(10) Patent No.: US 7,503,391 B2
(45) Date of Patent: Mar. 17, 2009

(54) TIEBACK CONNECTOR

(75) Inventors: Jason C. McCanna, Houston, TX (US); Larry E. Reimert, Houston, TX (US)

(73) Assignee: Dril-Quip, Inc., Houston, TX (US)

( * ) Notice: Subject to any disclaimer, the term of this patent is extended or adjusted under 35 U.S.C. 154(b) by 0 days.

(21) Appl. No.: 11/142,858

(22) Filed: Jun. 1, 2005

(65) Prior Publication Data

US 2005/0269102 A1 Dec. 8, 2005

Related U.S. Application Data

(60) Provisional application No. 60/576,800, filed on Jun. 3, 2004.

(51) Int. Cl.
*E21B 29/12* (2006.01)

(52) U.S. Cl. ..... 166/343; 166/350; 166/367; 285/123.1

(58) Field of Classification Search ..... 166/343, 166/345, 350, 367; 285/123.1–123.9
See application file for complete search history.

(56) References Cited

U.S. PATENT DOCUMENTS 2,353,572 A * 7/1944 Kuster et al. ..... 285/408
3,288,493 A * 11/1966 Brown ..... 285/3
4,347,944 A * 9/1982 Moldrup ..... 220/320
4,456,070 A * 6/1984 Watkins ..... 166/345
4,465,134 A 8/1984 Watkins ..... 166/245
4,478,287 A * 10/1984 Hynes et al. ..... 166/341
4,611,829 A * 9/1986 Hughes ..... 285/18
4,613,162 A * 9/1986 Hughes ..... 285/27
4,635,728 A * 1/1987 Harrington ..... 166/341
4,647,254 A * 3/1987 Baugh et al. ..... 405/169
4,673,041 A 6/1987 Turner et al. ..... 166/340
4,681,166 A * 7/1987 Cuiper ..... 166/345
4,902,044 A 2/1990 Williams et al. ..... 285/18
4,941,691 A * 7/1990 Reimert ..... 285/39
5,069,287 A 12/1991 Short et al.
5,095,991 A * 3/1992 Milberger ..... 166/380
5,255,743 A * 10/1993 Adam et al. ..... 166/345
5,279,369 A * 1/1994 Brammer ..... 166/368
5,433,274 A * 7/1995 Graff et al. ..... 166/368

(Continued)

OTHER PUBLICATIONS

Cooper Cameron Corporation; "Cameron Innovations—Dry Completion Systems, Aftermarket Services"; Cameron Division Brochure, Apr. 2003.

(Continued)

*Primary Examiner*—Thomas A Beach
(74) *Attorney, Agent, or Firm*—Paul R. Morico; Baker Botts L.L.P.

(57) ABSTRACT

A tieback connector for attaching a riser to a subsea production assembly is provided. The tieback connector includes a main body adapted to be coupled to the subsea production assembly having a central passageway sufficiently large to pass an end of the riser string therein and a connector positioner coupled to the main body, which is adapted to secure the tieback connector around a circumferential surface of a wellhead of the subsea production assembly. The tieback connector further comprises an aligning extension portion defined by a funnel-shaped tip, which aids alignment of the riser terminus during landing of the riser string onto the wellhead. The tieback connector secures the riser to the wellhead.

25 Claims, 18 Drawing Sheets

U.S. PATENT DOCUMENTS

| | | | | |
|---|---|---|---|---|
| 5,566,761 | A * | 10/1996 | Pallini et al. | 166/345 |
| 5,749,676 | A * | 5/1998 | Head | 405/171 |
| 6,035,938 | A | 3/2000 | Watkins | 166/345 |
| 6,293,343 | B1 * | 9/2001 | Pallini et al. | 166/345 |
| 6,336,508 | B1 * | 1/2002 | Guinn | 166/339 |
| 6,401,958 | B1 * | 6/2002 | Foss et al. | 220/320 |
| 6,499,773 | B1 * | 12/2002 | Östergaard | 285/408 |
| 6,536,527 | B2 | 3/2003 | Munk et al. | 166/345 |
| 6,540,024 | B2 | 4/2003 | Pallini et al. | 166/348 |
| 6,595,293 | B2 | 7/2003 | Carter | 166/345 |
| 6,609,731 | B2 | 8/2003 | DeBerry et al. | 285/123.4 |
| 2002/0096878 | A1 | 7/2002 | DeBerry et al. | |

OTHER PUBLICATIONS

UK Search Report for GB0620827.6 Mailed Feb. 19, 2007.

* cited by examiner

TIEBACK CONNECTOR

CROSS REFERENCE TO RELATED APPLICATION

This application claims priority to U.S. Provisional Application No. 60/576,800 filed on Jun. 3, 2004.

BACKGROUND

The invention relates to the connection of a marine riser between a wellhead on the seafloor and a pressure-controlling valve assembly (tree) upon a floating platform at the sea's surface. The platform may be used for the production of hydrocarbons (such as a SPAR, Deep Draft Caisson Vessel, or Tension Leg Platform), or for drilling into hydrocarbon reservoirs. The ends of the marine riser typically possess some physical features for connection and reaction of the loads between these widely separated parts. One such feature is termed a "stress joint", a segment of the riser with a varying, specially shaped cross-section for a smooth transfer of load and deflection to the terminus of the riser with minimum stresses. Another such feature is one or more parts or specially shaped surfaces that are attached, or can be attached, to the terminus of the riser that allow for a remotely operated connection to be made. The requirements of any connection features are demanding. Though the stress joint and riser flex significantly, there are still residual bending moments and tensions that must be transmitted through the connection in order to keep it securely water- or gas-tight. In addition, the connecting features must enable mate-up and demating between the riser's lower terminus and the wellhead. Such mating must occur remotely, underwater, and sometimes in poor conditions. Back-up and fail-safe functions may be necessary.

As a result, the various connection features are typically embodied in an equipment assembly attached to the riser's lower terminus and called a "subsea tieback connector". The assembly is composed of a number of robust, highly engineered components. Historically, many such connector assemblies were "female", swallowing a specially contoured surface on the exterior of the wellhead (making it the "male"), such as a mandrel or hub. The connector parts could then be made as large as needed in order to carry the load and execute their numerous functions.

On any floating hydrocarbon production platform, space and buoyancy are limited. One method for supporting the weight and tension of a marine riser is with individual flotation vessels, termed "air cans". The air-cans may be permanently attached to the riser along a significant part of its length (termed "integral"), or only at a single point (termed "non-integral"). In the latter case, all but the uppermost part of the riser string must drift through a passage formed in the center of the air-cans. The drifting parts include the lower terminus and any features for the lower connection.

To this end, it is desirable for the lower terminus and any connection features to be as small a diameter as possible, so that the opening in the air can is likewise as small as possible, in order to maximize the amount of flotation afforded by said air-can.

The design challenge is to enable the necessarily robust connection features, while keeping the overall diameter small. This has resulted in prior art with complex designs, costly high-performance materials, costly specially shaped parts, and/or overly sensitive operation. And typically the connection strength is still limited relative to a connector not so constrained.

An alternative to squeezing all the connection features into the restricted air can diameter, is to have only the bare minimum of said features attached to the lower terminus. The remaining features must then be provided in a separate assembly. The features on the lower terminus may be limited to a special profile formed on the exterior, similar to that on the wellhead.

The separate assembly must be independently placed subsea in the vicinity of the wellhead. The placement may be executed at any time by a small boat and submersible ROV (Remotely Operated Vehicle) independent of the operations on the platform. Said assembly must enable a connection between essentially three separate members: the riser's lower terminus with minimized connection features, the connector assembly itself, and the wellhead.

An ideal connector for this application has only one sealing joint, one leak path, one set of functions, can be independently pre-placed and operated by an ROV, withstands very high loads, and needs a passage through the air cans no larger than the minimum required stress joint. To this end, the following invention—a tieback connector for subsea tieback—is applied.

SUMMARY

In one embodiment, the present invention is directed to a tieback connector for attaching a riser string to a subsea production assembly. The tieback connector includes a main body adapted to be coupled to the subsea production assembly. As used herein, the terms "couple," "couples," "coupled" or the like, are intended to mean either indirect or direct connection. Thus, if a first device "couples" to a second device, that connection may be through a direct connection or through an indirect connection via other devices or connectors. The main body of the tieback connector has a central passageway sufficiently large to pass an end of the riser string therein. The tieback connector also includes a connector positioner coupled to the main body on an inner surface thereof, which is adapted to secure the tieback connector around a circumferential surface of a wellhead of the subsea production assembly. In one embodiment, the main body is adapted to be coupled to the subsea production assembly subsea by an ROV. In another embodiment, the main body is adapted to be coupled to the subsea production assembly at the surface. In yet another embodiment, the main body is adapted to be coupled to the end of the riser string.

In one embodiment, the tieback connector may also include an extension portion coupled to the tieback connector. The extension portion has a profile adapted to correct any misalignment of an end of the riser string (riser terminus) during landing of the riser string on the subsea production assembly. The profile of the extension portion has a generally cylindrical shape which is tapered along its length from a top end, which is defined by a generally funnel-shaped opening, to a bottom end which couples to the main body. Furthermore, the extension portion may be formed with an inwardly projecting rib formed adjacent to the funnel-shaped opening.

In one embodiment, the tieback connector further includes an intermediate actuator ring disposed within the main body and an inner latching ring disposed within the intermediate actuator ring; the inner latching ring having upper and lower grooves adapted to engage a wellhead of the subsea production assembly. The intermediate actuator ring and inner latching ring have cooperating tapered surfaces which enable generally axial or vertical movement of the actuator ring to translate into generally radial or transverse movement of the inner latching ring. The tieback connector may further include a hydraulic pressure valve coupled to the main body, which when activated supplies pressurized fluid to a sealed chamber disposed between the intermediate actuator ring and an inner wall of the main body. The pressurized fluid forces the intermediate actuator ring to move generally vertically (axially), which in turn causes the inner latching ring to move generally radially (transversely) into engagement with the wellhead. As those of ordinary skill in the art will appreciate, however, mechanical means can be used to accomplish the movement of the intermediate actuator ring relative to the inner latching ring.

In one embodiment, the connector positioner includes a single ring-shaped band having opposed flanges, which fits around the circumferential surface of the wellhead. In another embodiment, the connector positioner comprises a pair of yokes each having a pair of flanged ends, which are arranged around the circumferential surface of the wellhead such that the flanged ends face each other. The connector positioner may further include one or more hydraulic cylinders or mechanically operated cylinders which operate to tighten the connector positioner around the circumferential surface of the wellhead.

The present invention has a number of advantages. One such advantage is that the connector installation is off the critical path of operations of the production platform. As such, the operation becomes cheaper. Another advantage is that in the event the connector fails to latch properly, it can be replaced without having to break and re-make the entire riser string. The consequences and cost of risk are thereby much reduced. Furthermore, the size of the passage through the air-cans can be minimized. Other advantages include: a single element connecting the wellhead and riser terminus; a single leak tight joint between the wellhead and riser terminus; a single high-load mechanism for effecting the connection; connection mechanisms, and their parts, need not be designed and built for the demands of a smaller overall diameter; existing, proven latching/connecting elements can be used; and the load capacity is not reduced such as would be true if the connector were constrained to a small overall diameter.

BRIEF DESCRIPTION OF THE DRAWINGS

A more complete understanding of the present disclosure and advantages thereof may be acquired by referring to the following description taken in conjunction with the accompanying drawings wherein.

Figure 1:
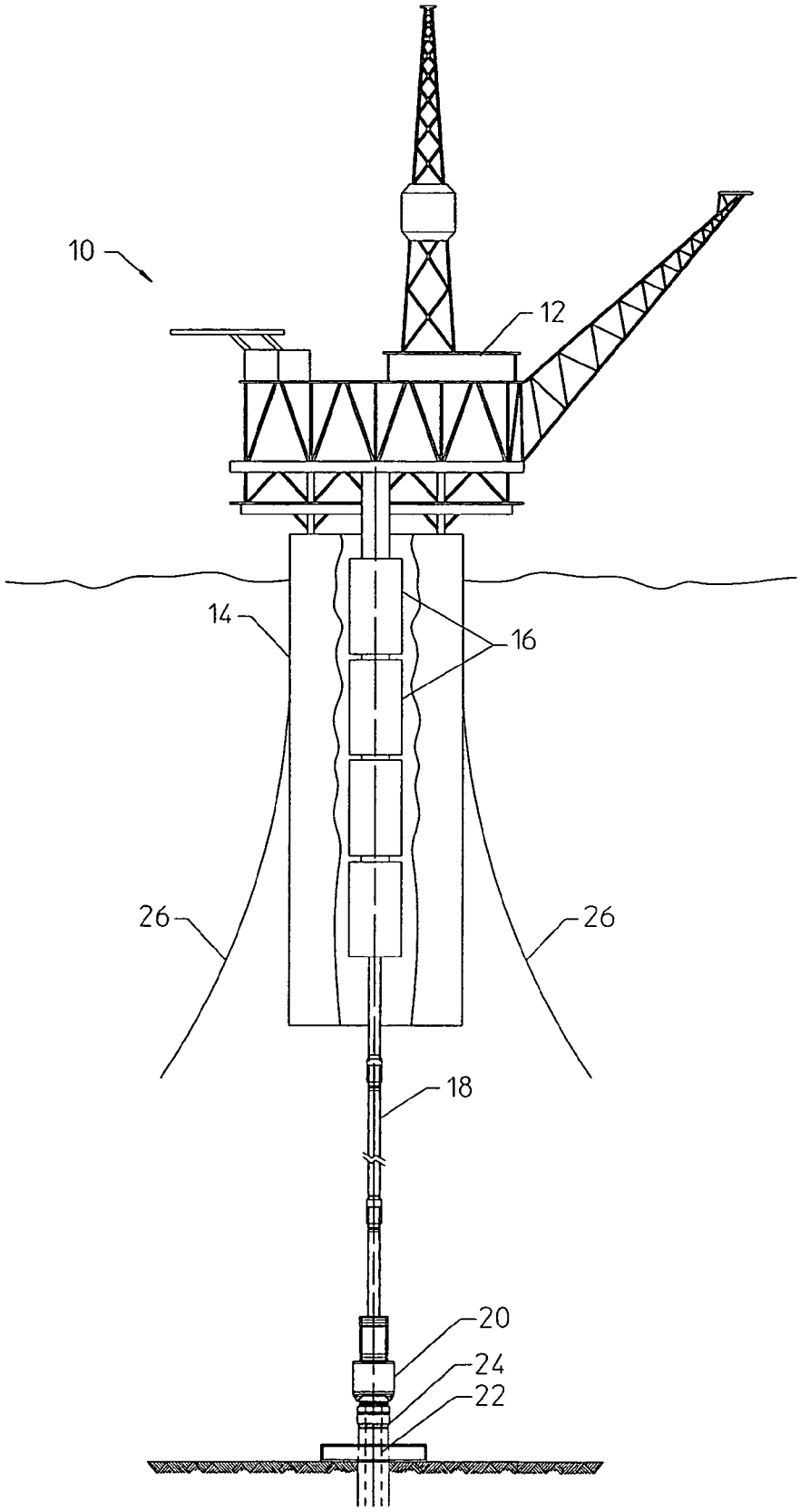
FIG. 1 is a schematic drawing illustrating a production platform, including air cans and riser string secured to a subsea wellhead by a tieback connector in accordance with the present invention.

The present invention may be susceptible to various modifications and alternative forms. Specific embodiments of the present invention are shown by way of example in the drawings and are described herein in detail. It should be understood, however, that the description set forth herein of specific embodiments is not intended to limit the present invention to the particular forms disclosed. Rather, all modifications, alternatives and equivalents falling within the spirit and scope of the invention as defined by the appended claims are intended to be covered.

DETAILED DESCRIPTION

Essential to most any subsea tieback connection is the wellhead, incorporating some specially shaped profile on the exterior surface for a connecting element to engage. Also essential is the riser's lower terminus (or an extension thereof termed a "connector body"), likewise with a similar profile on the exterior surface for a connecting element to engage. The connecting element itself forms an annular band around the profiled portions of the wellhead and riser terminus. The inner surface of the connecting element has profiles essentially matching those on the wellhead and riser terminus. The connecting element may be a series of discrete latching segments (often termed "dogs"), a collet, a flexible split ring, a pair of clamps, or a series of threaded fasteners.

Where the various connection schemes differ from one another is the design of the latching profile, the means of closing the latching element around the joint, the means of ensuring correct positions between the wellhead, riser terminus, and connecting element, and the method of operation of all said elements.

In one certain embodiment of the invention, the connecting element has a camming surface on the outer diameter outside of the portion that latches to the profiled riser terminus, and another camming surface outside of the portion that latches to the wellhead profile. In one certain embodiment, the camming surfaces over the riser terminus and wellhead are radially offset from one another.

In one certain embodiment, a cam ring partly encloses and retains the connecting elements. It has surfaces on its inner diameter that mate with the cam surfaces on the connecting element. Vertical (axial) movement of the cam ring transmits radial force and radial movement to the connecting element (s), which thereby applies the clamping force between riser terminus and wellhead. Force is applied to upper or lower surfaces of the cam-ring by hydraulic pressure, to effect movement down or up, respectively.

In an alternative embodiment, force is applied to upper and lower surfaces of the cam-ring by a separate tool operated by the ROV.

In another alternative embodiment, more than one cam-ring may act upon the different camming surfaces of the connecting element(s).

Both camming surfaces may have portions with a steep angle that allow the connecting element to close the majority of the clearance between it and its mates. Both camming surfaces also have a portion at a shallow angle to highly amplify the camming force into a clamping force. With the help of moderate friction, the shallow angle also retains that force and the resulting position to maintain a preload across the joint.

One or more projections off the cam ring may engage with other cam surfaces on the connecting element, angled so as to provide a radially outward spreading force and movement of the connecting element when the cam ring moves vertically up. An outer membrane with upper and lower bulkheads contains the hydraulic pressures for downward or upward movement of the cam ring.

The connecting element has an open position and shape large enough to easily slide over the wellhead profile, and large enough for the riser terminus to be easily inserted into the connecting element. An upward facing funnel or similar guiding means may assist in the aligning, positioning, and insertion of the riser's lower terminus. The funnel may have a special profile to promote self-aligning of the riser terminus.

A means for accurately positioning, particularly in the vertical sense, the tieback connector upon the wellhead prior to insertion of the riser terminus is also provided. The correct position allows proper operation of the connecting element, maximizes the draw-in distance and positional tolerance of the riser terminus, and maximizes the preload of the connection.

In the specific embodiment, the position of the connecting element with respect to the wellhead is fixed by an element that grips the wellhead, typically in a place beyond the special connecting profile. The gripping element also has an open position that allows the tieback connector to be slid over the wellhead. The gripping element may be actuated by different means, such as by an annular hydraulic cam ring, similar to that used to effect the main connection, though much smaller. The gripping element and its actuating means are sized to provide only enough clamping force to bear the weight of the tieback connector, and to react some small bending moments resulting from aligning the riser terminus as it is inserted.

When the main connecting element forcefully mates up the riser terminus and the wellhead, it must override the force and position of the auxiliary gripping element. When the main connection element demates the riser terminus and wellhead, it must override any residual positioning force left in the gripping element.

In various embodiments of the invention, there are numerous ways to effect the function of the gripping element. The gripping and actuating means may include: slips, dogs, a flexible band, gripping teeth of various angles, a camming ring, surfaces and chambers for applying hydraulic pressure to a camming ring in one or another direction at various times, powerful permanent or electric magnets, shear pins, detents, yielding elements, or even a rotary drive mechanism to tangentially cinch a flexible band. Different amounts of extra volume or other compliance in the energizing hydraulic circuit can maintain its pressure and grip over a period of hours to months by design.

The tieback connector can be mounted upon a handling tool by latches or dogs or some other means. Any method of attaching/detaching must be ROV-friendly. In one certain embodiment, a simple flip lever engages/disengages the catches.

A portion of the tool's structure extends into the tieback connector, ending in a firm foot in the vicinity of the connecting element, of a diameter to contact the top of the wellhead. When the foot rests upon the wellhead, it thereby sets the location of the tieback connector—and therefore of the critical connecting element—with respect to the wellhead. The foot position may also be manually adjusted, to guarantee a correct, accurate distance between the foot and the latches that hold the tieback connector. Since each tool will typically deploy several connectors at different times, such adjustment is necessary to compensate for variances in construction. The adjustment is locked in place during the deployment, by such means as heavy set screws, etc.

In an alternate embodiment, the foot may also have means of holding and releasing a wellhead gasket. In such case, it may rest and locate upon the gasket in lieu of the wellhead, and the gasket locates to a special profile in the wellhead.

In another alternate embodiment, the gripping element is included in a positioner ring, separate from the connector. The positioner ring is deployed by the ROV and attached to the wellhead prior to deploying the actual connector. In this case, the positioner ring is deployed on a tool, which has a foot to set its location with respect to the top of the wellhead. The tieback connector is then subsequently deployed to the wellhead by the ROV, and simply comes to rest upon the accurately placed positioner ring.

Other options and features may be added to the connector without departing significantly from the spirit of the invention. Such may include back-up hydraulic functions, ratchets, mechanical interfaces for the ROV to stroke the cam ring, and means to indicate the position of the moving parts. Also, the tieback connector or positioner ring may be deployed from a crane or winch off the floating platform as well as a workboat.

The tieback connector, its handling tool, and an ROV are deployed from a workboat. The weight of the connector and the handling tool may be supported by flotation or a downline off the workboat. The ROV hot-stabs into the hydraulic circuit of the Tieback connector that controls the gripping element. It then aligns the connector as it is lowered over the wellhead. When the foot of the handling tool comes to rest upon the wellhead, the ROV energizes the gripping hydraulic function. The ROV then closes off the hot-stab circuit, retaining pressure in the gripping element. The ROV then unlatches the handling tool from the tieback connector. The ROV can continue to deploy multiple tieback connectors over the subsea oilfield.

If there is a significant duration between connector deployment and riser deployment, the ROV may cover the opening in the connectors with light-weight caps to prevent interference by debris.

Meanwhile, the floating production platform constructs the riser, section by section, threading it through the air-cans. At some point, the riser's lower terminus has reached the depth of the wellheads. The ROV removes the debris cap from the connector. The ROV then uses another handling tool (or its own gripper or padded push-bar) to guide the lower terminus into the funnel of the Tieback connector. The production platform lowers the terminus onto the wellhead.

The ROV then hot-stabs into the primary circuit of the connector, energizing the "latch" function, so that the connecting element contracts simultaneously around the wellhead and riser terminus profiles. Since the profiles typically incorporate angled flanks, this draws the wellhead and riser terminus together, aligns them to a fine degree, applies an elastic preload to them, and compresses the gasket. It also draws the entire tieback connector slightly down over the wellhead. Meanwhile, the gripping element is made to slip, deform, back-off, or release hydraulic pressure (such as by a relief valve) as its force is overridden by the primary latch circuit.

Turning now to FIG. 1, an offshore production or drilling apparatus in accordance with the present invention is shown generally by reference numeral 10. The offshore apparatus 10 comprises a topsides 12; and a floating hull 14. Associated with production apparatus 10 is a riser system which comprises air cans 16; riser string 18; tieback connector 20; and production assembly 22, which comprises a wellhead 24. The hull 14 is stabilized by a plurality of mooring lines or tension members 26. The air cans 16 help to maintain the buoyancy of the riser system. As those of ordinary skill in the art will appreciate, an air can 16 is a generally donut shaped vessel hollow on the inside. It is filled with air on the inside thereby making it buoyant. It applies tension to the riser and eliminates the need for a tensioner which consumes the space and buoyancy of the hull 14. As those of ordinary skill in the art will appreciate, FIG. 1 shows a completely assembled offshore production apparatus.

Figure 2:
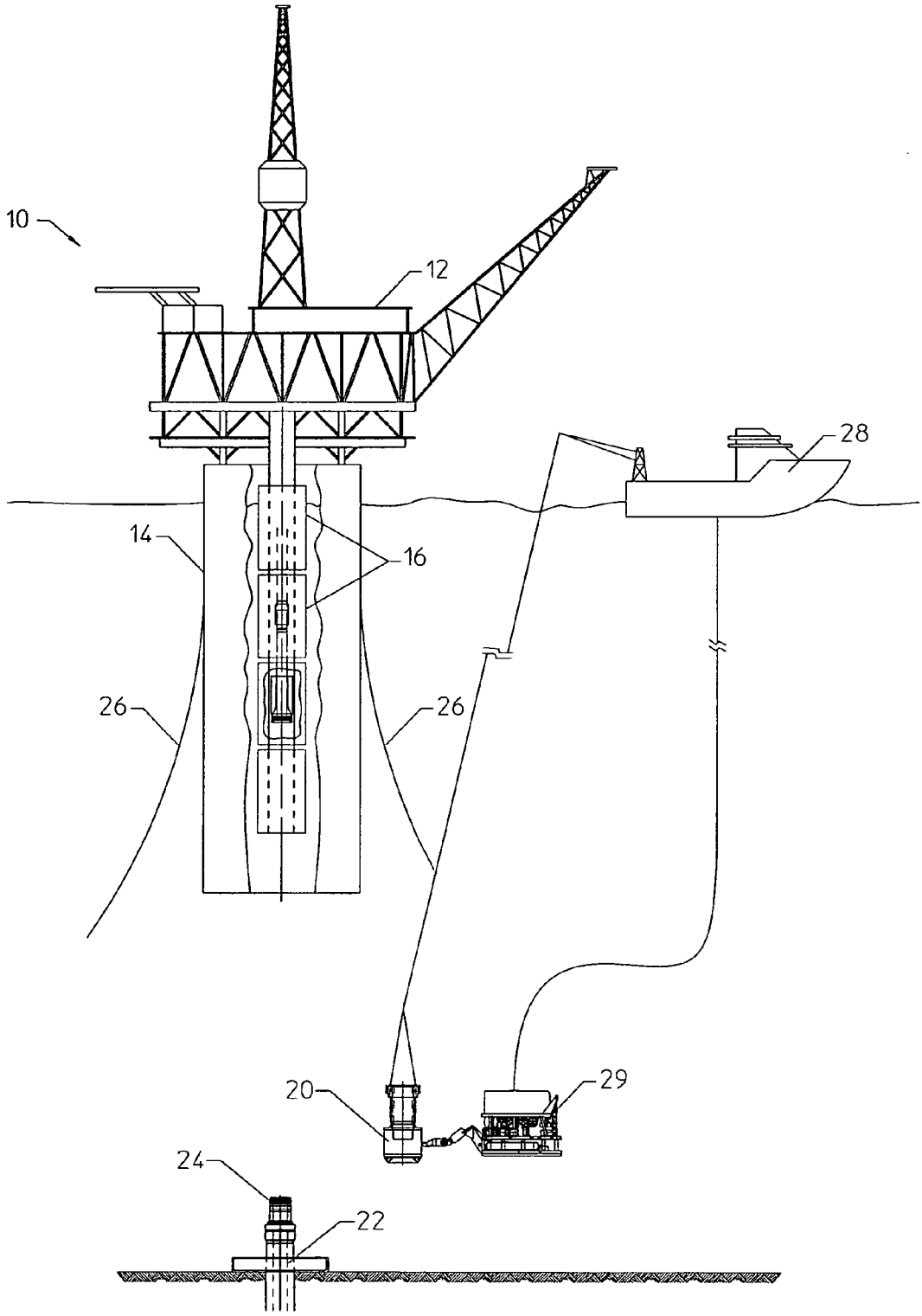
FIG. 2 is a schematic drawing illustrating a workboat lowering a tieback connector in accordance with the present invention onto a subsea wellhead of a subsea production assembly.

FIG. 2 illustrates a workboat 28 installing tieback connector 20 onto wellhead 24. An ROV 29 is used to align the tieback connector 20 over the wellhead 24, land the tieback connector 20 on the wellhead 24, and secure the tieback connector 20 to the wellhead 24, as described in greater detail below.

Figure 3:
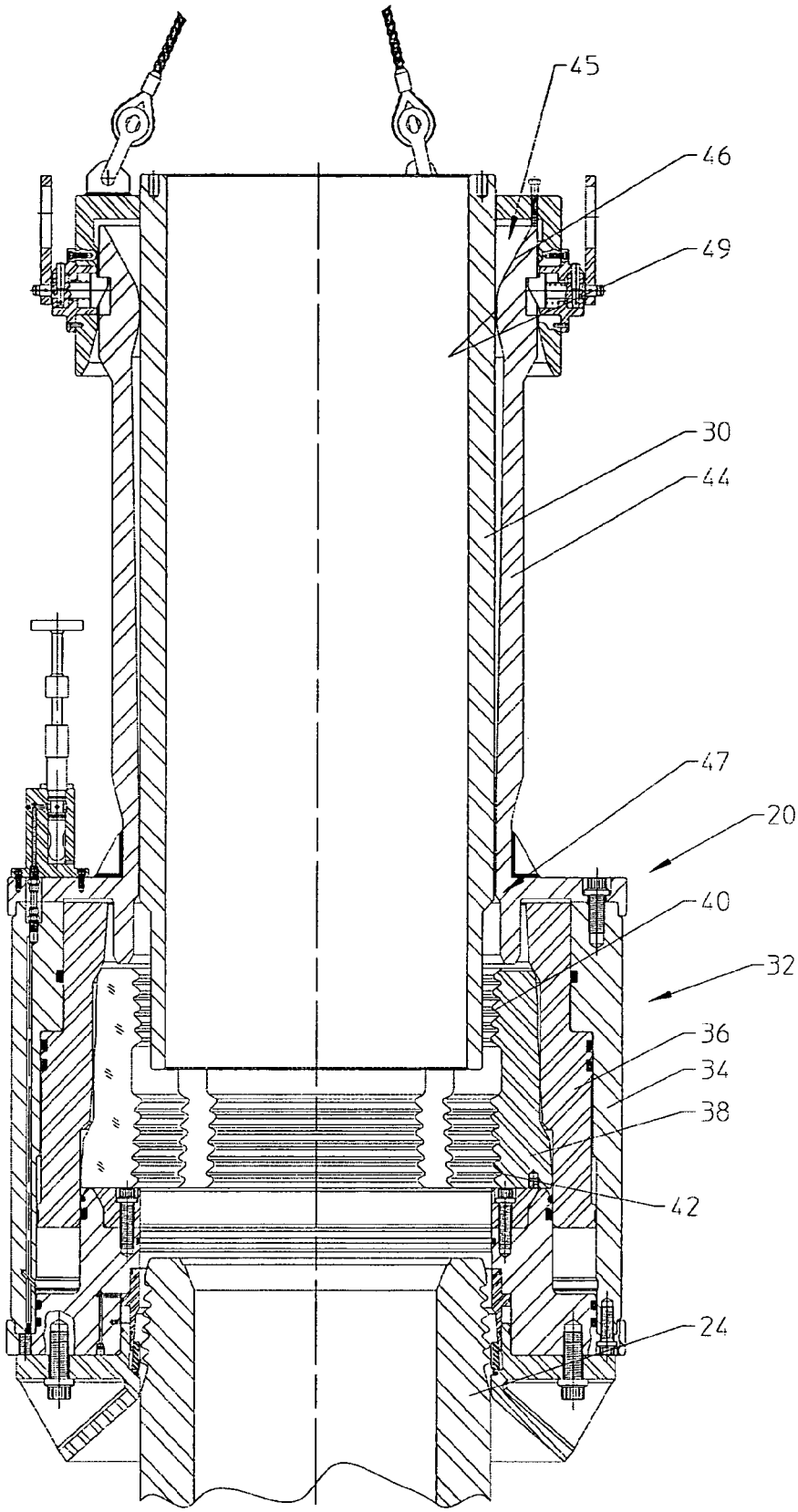
FIG. 3 illustrates deployment of the tieback connector in accordance with the present invention onto the wellhead of the subsea production assembly by a downline from a workboat or alternately, the platform crane, with an ROV (not shown) guiding the connector into place.

FIG. 3 illustrates the lowering of the tieback connector 20 onto the wellhead 24 with a handling tool 30 and ROV 29. As those of ordinary skill in the art will appreciate, the tieback connector 20 can be lowered from a wire rope off a crane on the production platform 10 or other similar mechanism in place of the workboat 28. The ROV 29 positions the tieback connector 20 into axial alignment with the wellhead 24. The handling tool 30 determines the vertical location of the tieback connector 20 relative to the wellhead 24.

Tieback connector 20 contains a main body 32 defined by an outer cylindrical wall 34. The main body 32 has a central passageway sufficiently large to pass an end of the riser string 18 therein. The tieback connector further includes an intermediate actuator ring 36 disposed within the main body 32, and an inner latching ring 38 disposed within the intermediate actuator ring 36. The inner latching ring 38 has upper and lower grooves 40 and 42. The inner latching ring 38 is formed of a plurality of annular segments which when placed together form an annular ring. In one specific embodiment, eight (8) segments come together to form the inner latching ring 38. The segments of the inner latching ring 38 are also known in the art as dog segments. The intermediate actuator ring 36 and the inner latch ring 38 have sloped surfaces, which cooperate with one another to cause the inner latching ring 38 to latch onto the riser 18 and the wellhead 24, as will be described further below. The actuator ring 36 is activated by hydraulic fluid, which forces the intermediate actuator ring 36 axially downward, which applies the radially inward force to the inner latching rings 38 via the cooperation of the angled surfaces between the intermediate actuator ring 36 and the inner latching ring 38.

The tieback connector 20 further comprises an aligning extension portion 44, which connects to the main body 32 at one end. The aligning extension portion 44 has a profile adapted to correct any misalignment of the end of the riser string being attached to the subsea production assembly, as shown in FIGS. 5-11. The profile of the extension portion has a generally cylindrical shape, which is tapered along its length from a top end 45, which is defined by a generally funnel-shaped tip or opening 46, to a bottom end 47, which couples to the main body 32. The extension portion also includes an inwardly projecting rib 49 formed adjacent to the funnel-shaped opening, which has a generally curve-shaped surface.

Figure 4:
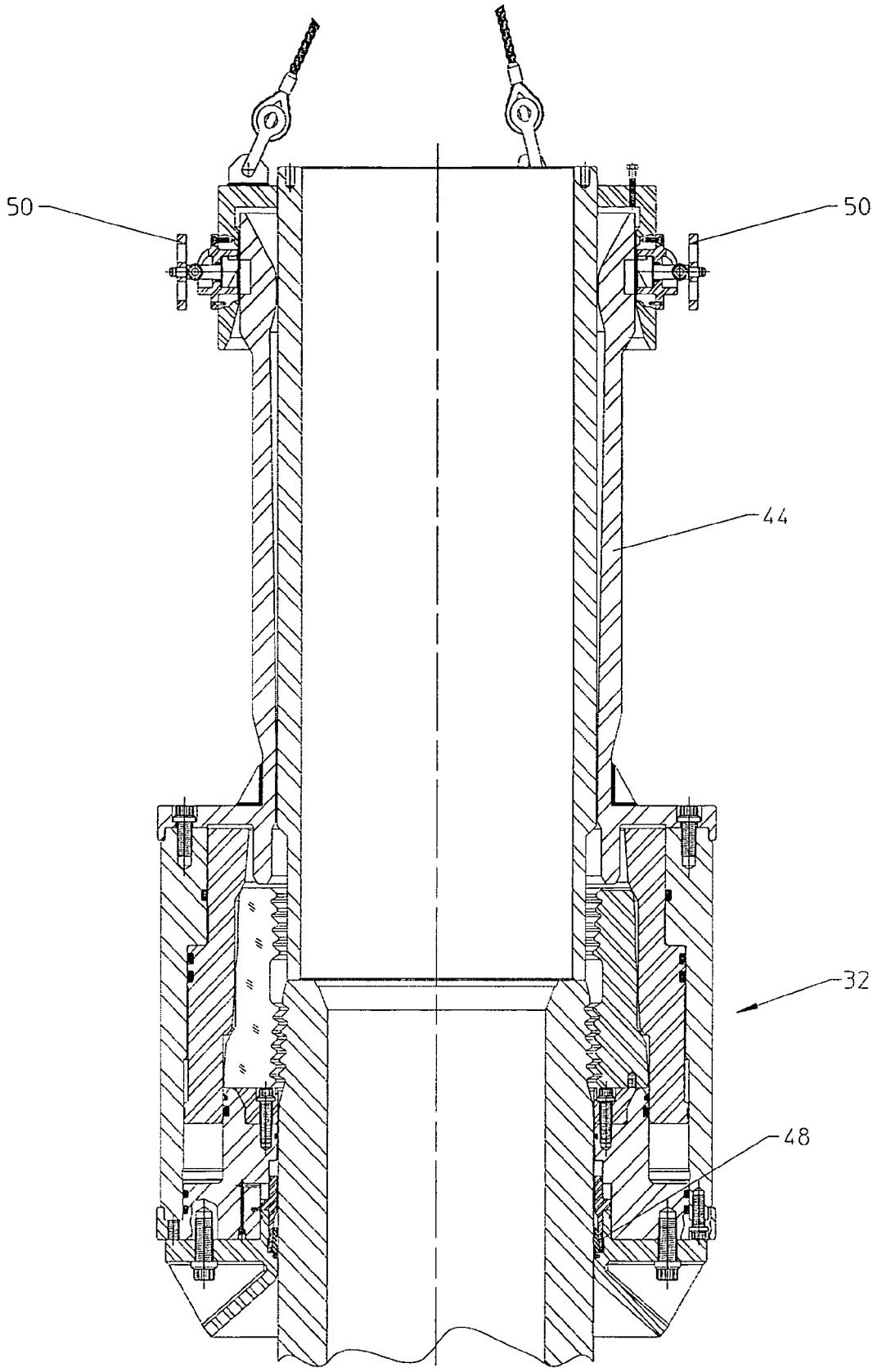
FIG. 4 illustrates final landing of the tieback connector onto the wellhead, securing of the tieback connector to the wellhead with a gripping band of the connector, and unlatching of the handling tool by the ROV.

FIG. 4 illustrates the tieback connector 20 being secured by gripping band 48 to the outer surface of the wellhead 24. Gripping band 48 is a circumferential clamping member which is a component of main body 32 of the tieback connector 20. After securing the position of the tieback connector 20, the ROV unlatches the handling tool 30 from the aligning extension portion 44 of the tieback connector 20 by flipping the levers of latching mechanism 50.

Figure 5:
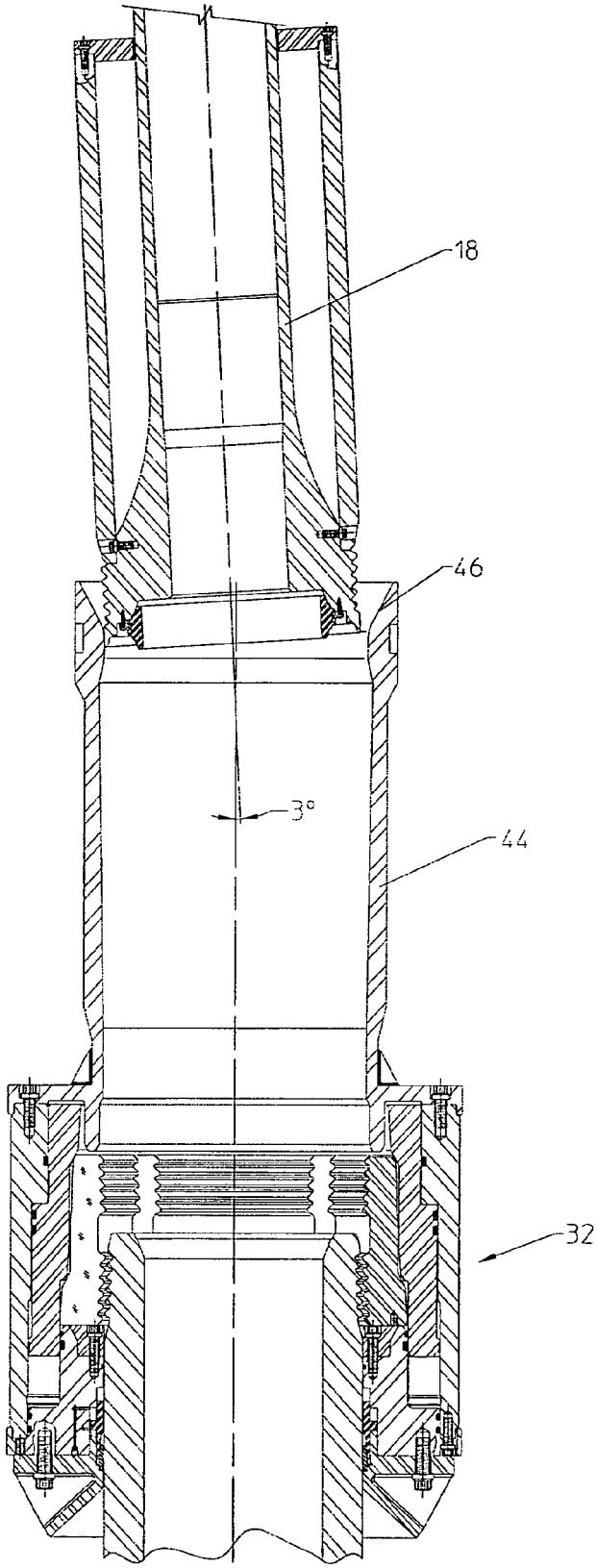
FIG. 5 illustrates alignment of the riser into position over the funnel-shaped tip of the tieback connector.

In the next step, the riser 18 is lowered into the aligning extension portion 44 by the floating platform 10, as illustrated in FIG. 5. The funnel-shaped opening 46 of the aligning extension portion 44 of the tieback connector 20 helps guide the terminus of the riser 18 into the tieback connector 20. The riser 18 is shown in FIG. 5 tilted from the axis of the wellhead 24 and tieback connector 20 at an angle of approximately 3° or larger.

Figure 6:
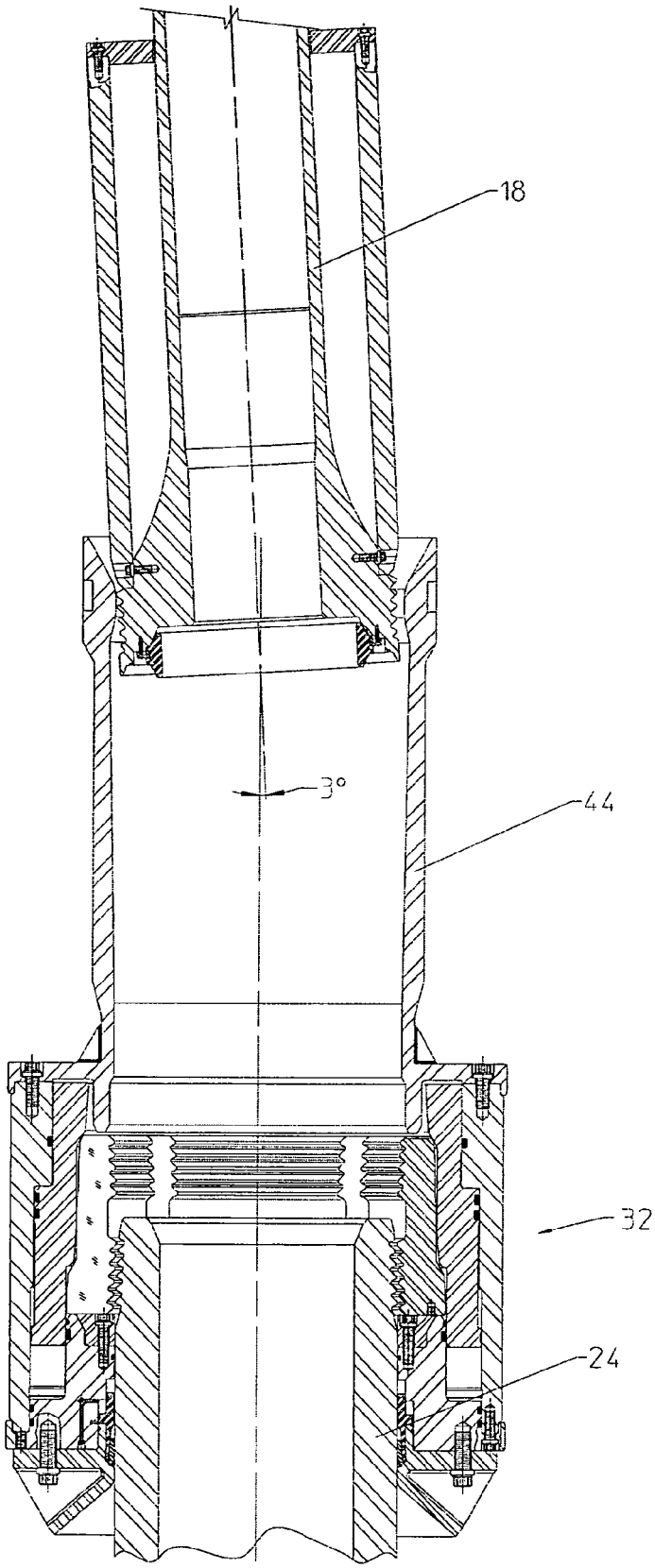
FIGS. 6-10 illustrate stabbing of the riser into the tieback connector.
Figure 7:
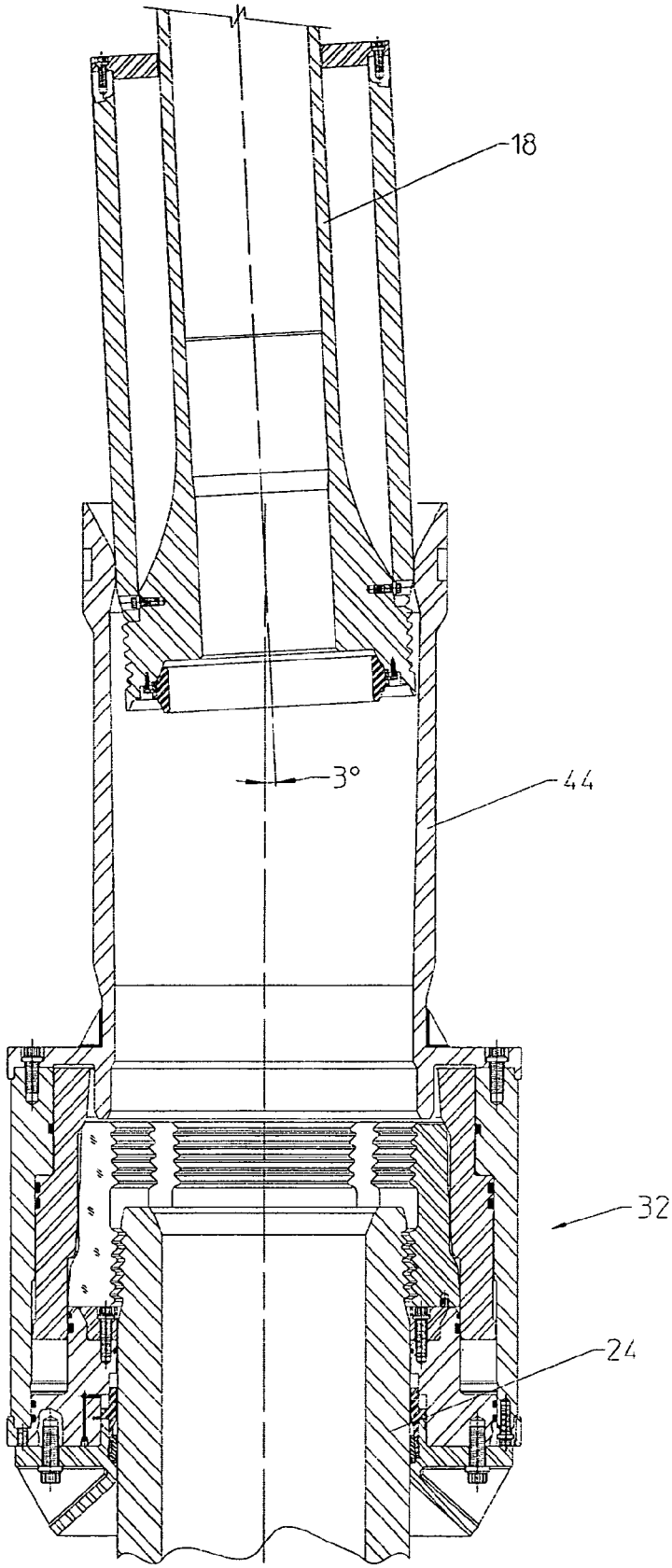
Figure 8:
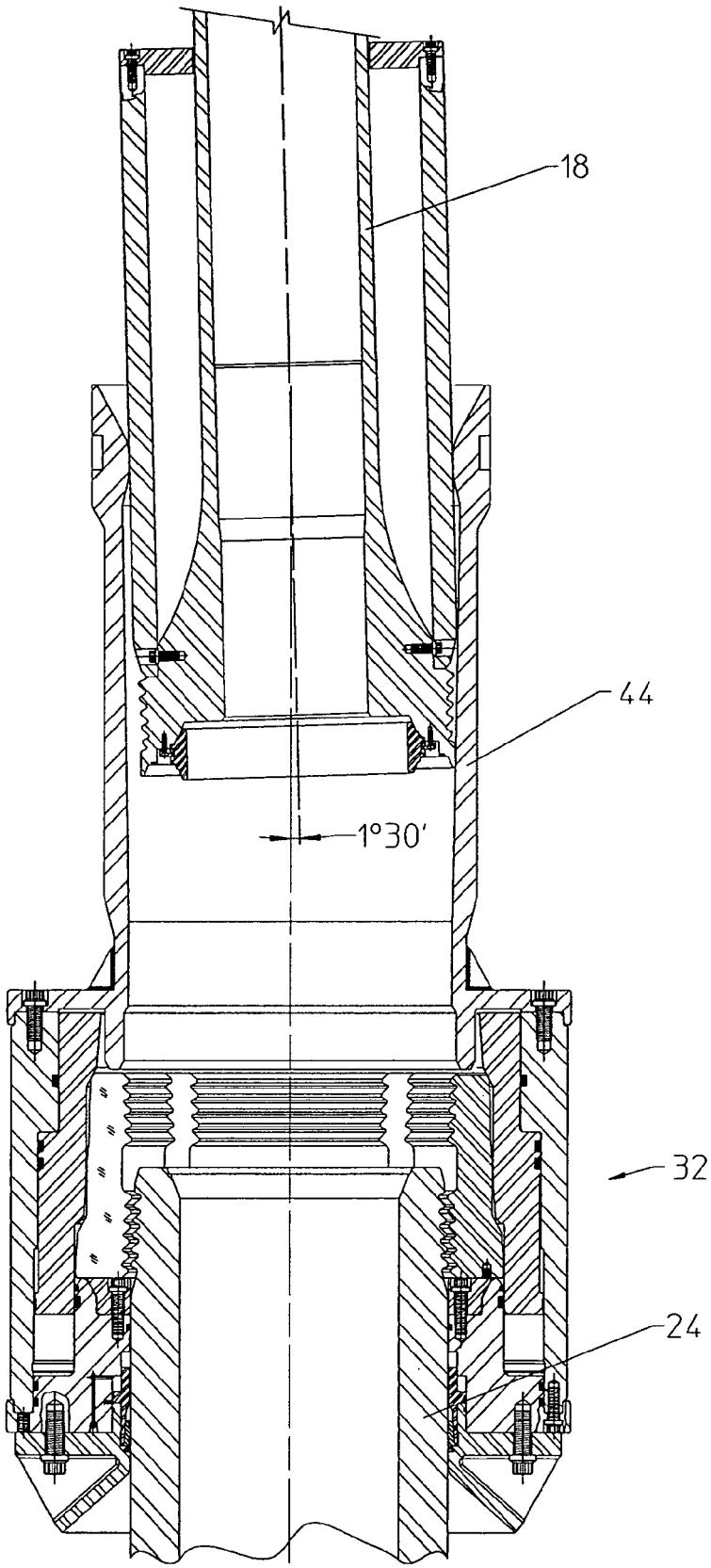
Figure 9:
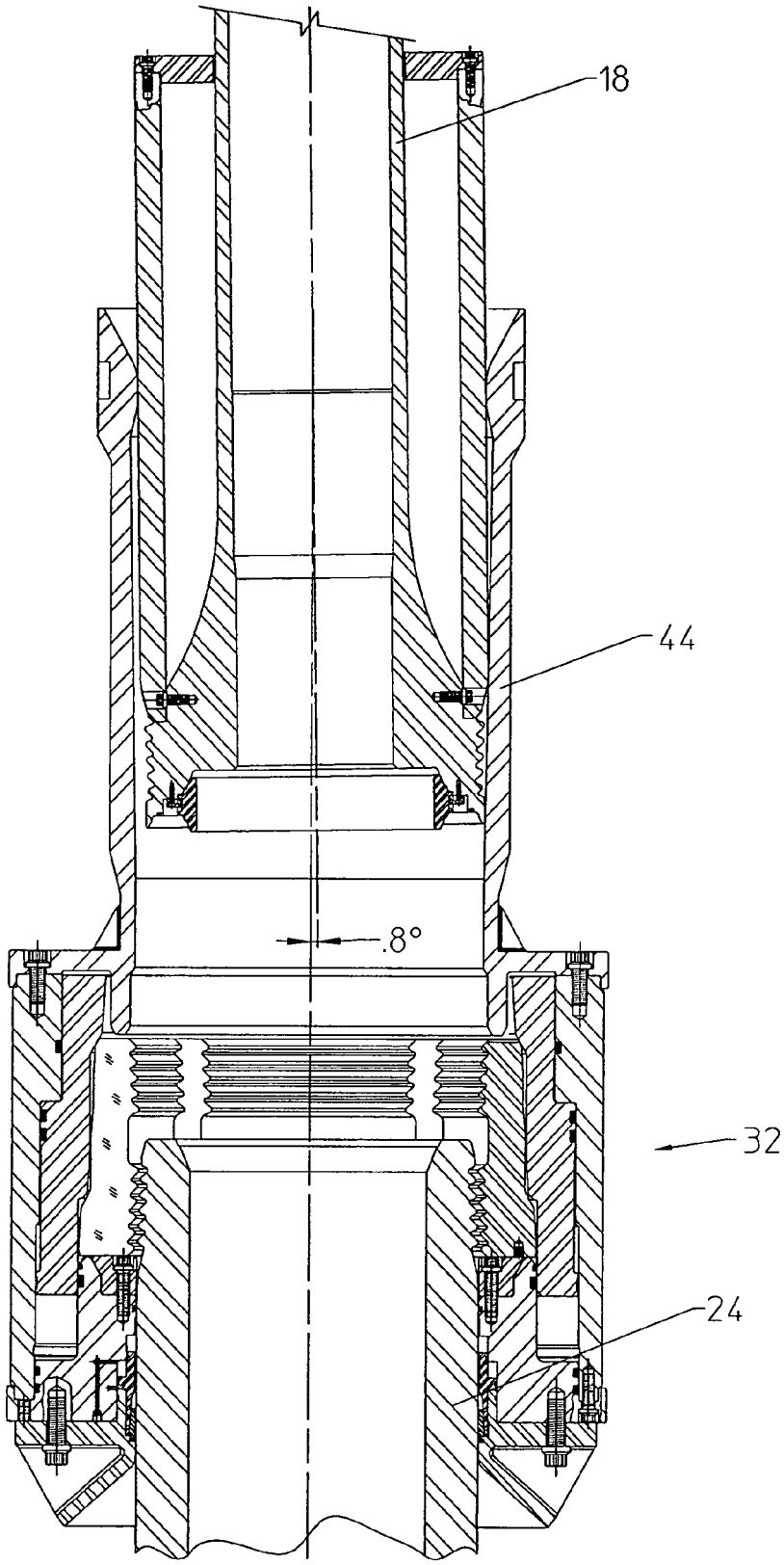
Figure 10:
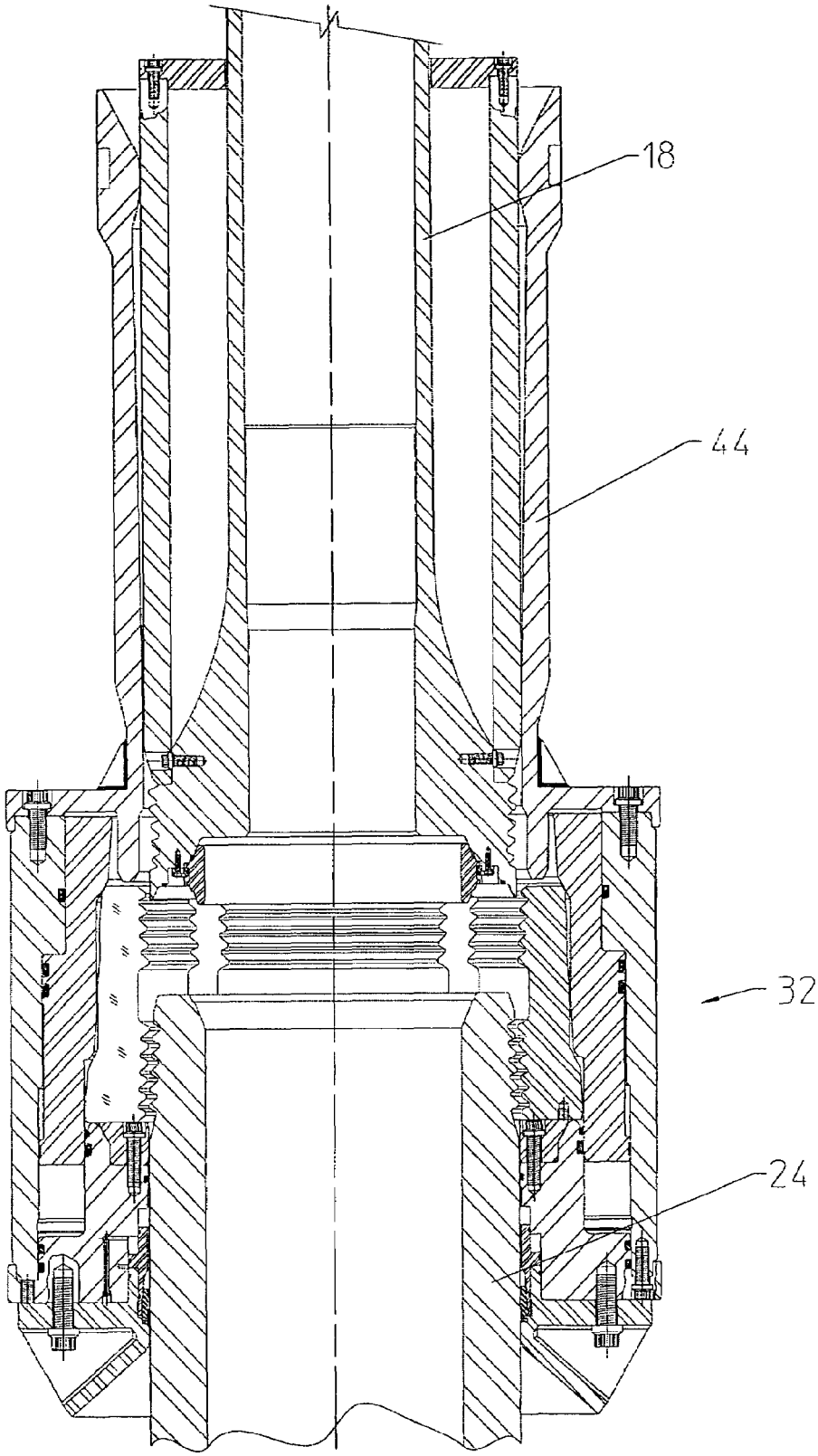
Figure 11:
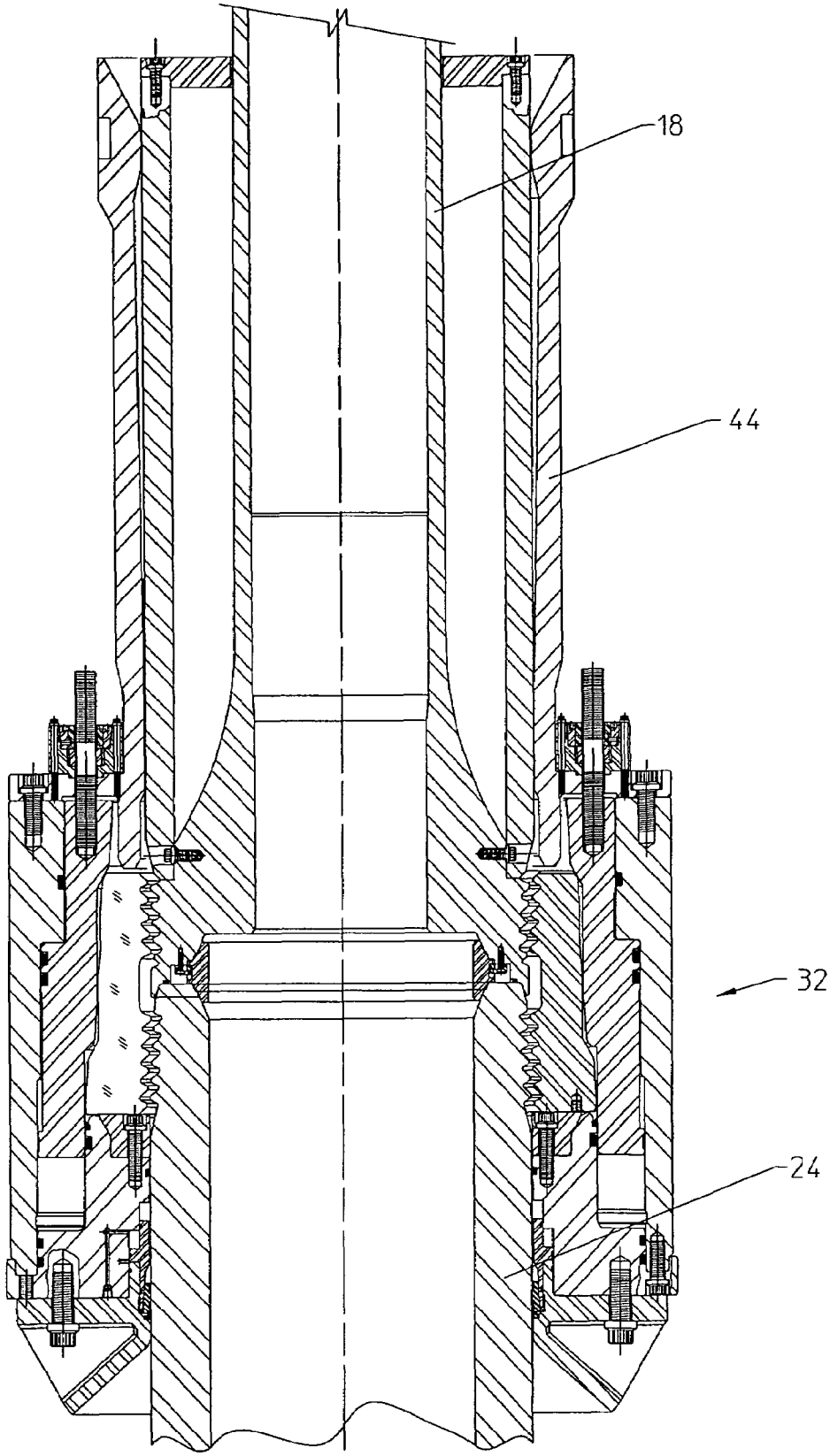
FIG. 11 illustrates the riser landed in the tieback connector onto the wellhead.

FIGS. 6 through 10 progressively illustrate stabbing the riser 18 into tieback connector 20. In FIGS. 6 and 7, the aligning extension 44 permits insertion of riser 18 with the aforementioned angular misalignment. In FIG. 8, the angle of riser 18 has been reduced by half (1°30') by interaction with aligning extension 44. In FIG. 9, the riser 18 is shown with very little angle to the wellhead axis, 0.8°. In FIG. 10 the riser 18 is shown aligned with the axes of the wellhead 24 and tieback connector 20 and centralized in two locations. Finally, in FIG. 11 the riser 18 is completely stabbed into tieback connector 20 and in full or near-contact with wellhead 24. The annular grooves formed at the end of the riser 18 are generally aligned in elevation with the teeth of the upper grooves 40 of the inner latching ring 38.

Figure 12:
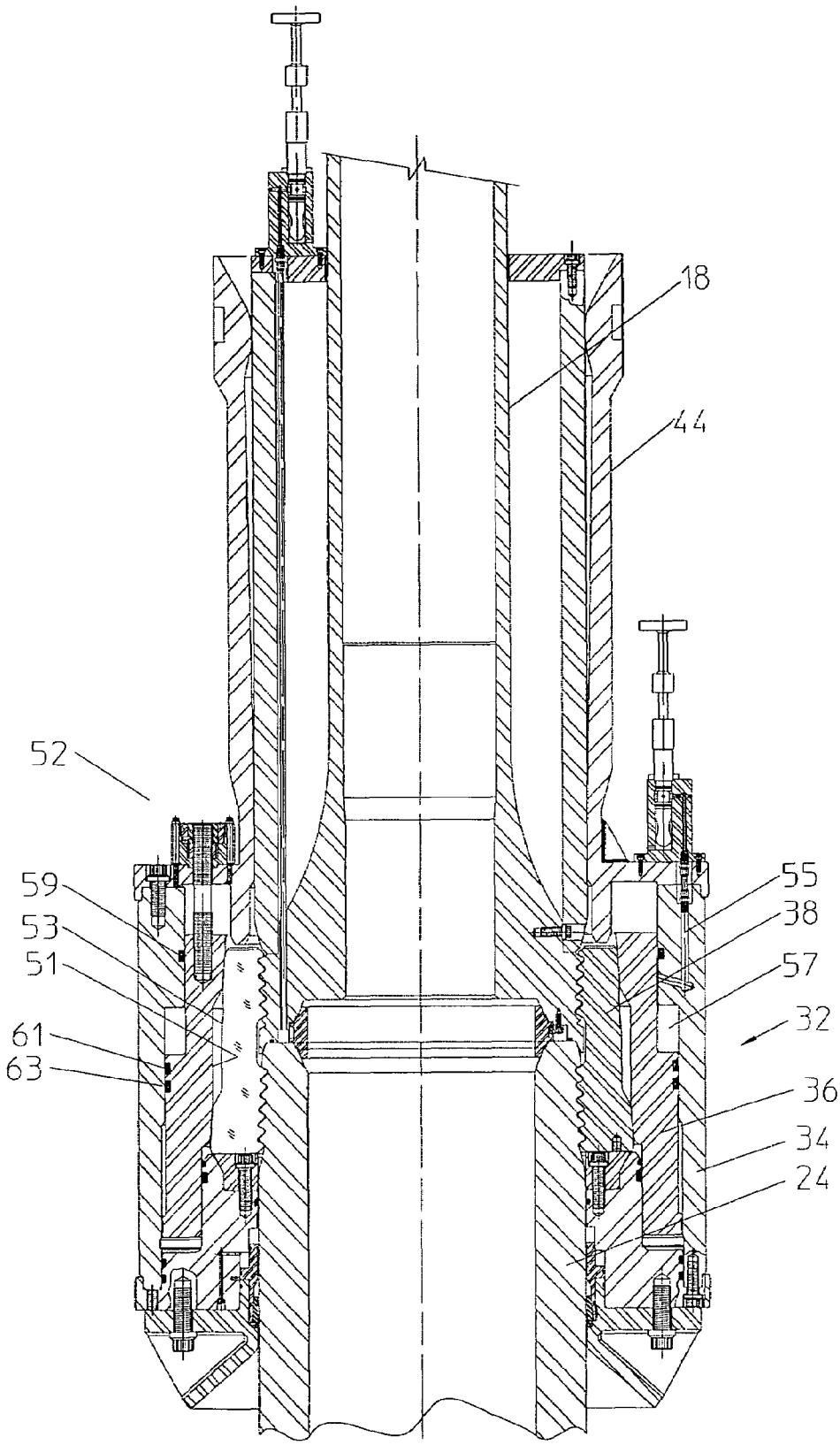
FIG. 12 illustrates latching of the tieback connector to the wellhead and riser by the ROV.
Figure 13B:
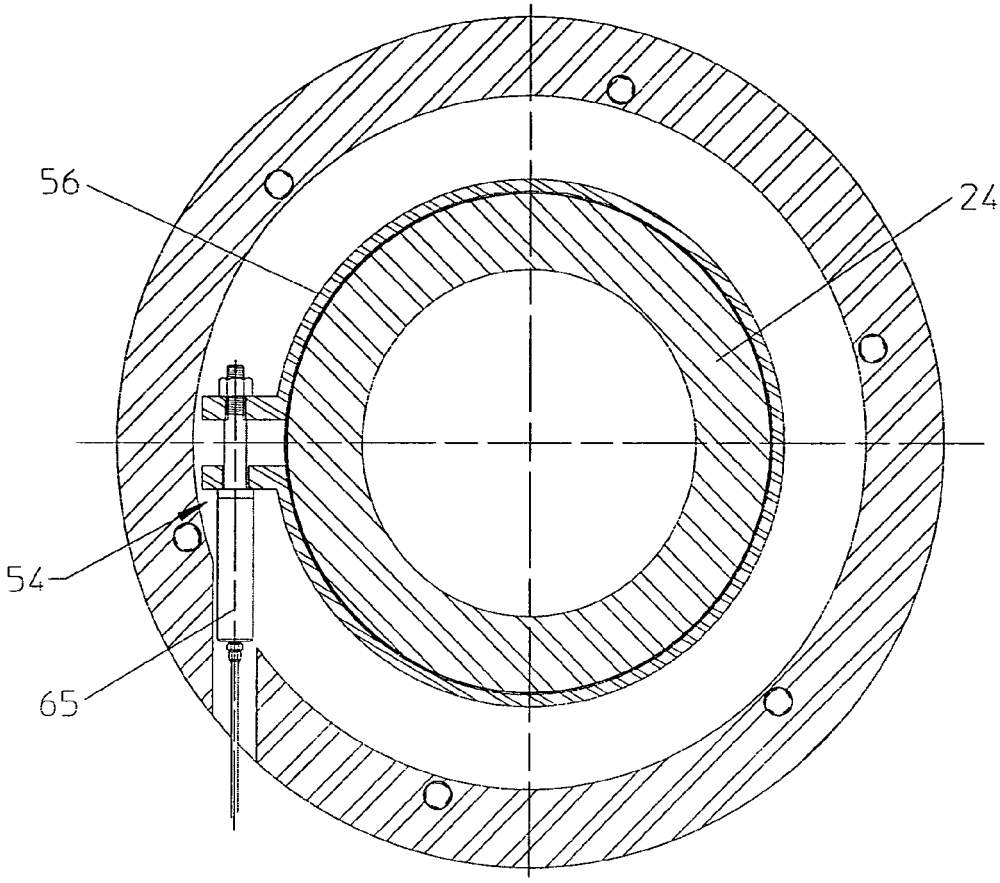
FIGS. 13A and 13B illustrate one embodiment of a connector positioner, which employs an ROV operated single hydraulic cylinder gripping band.
Figure 13A:
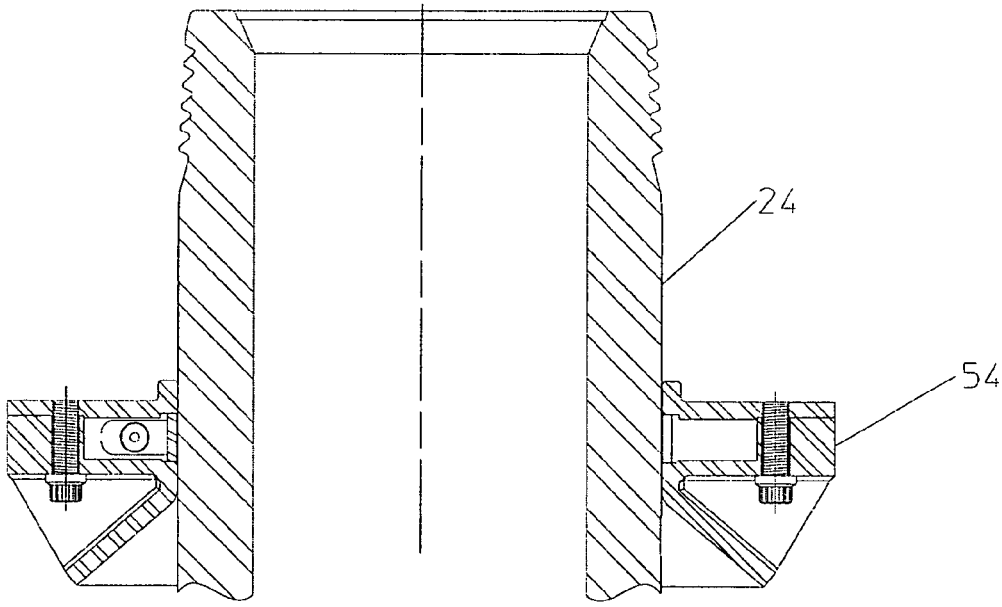

In FIG. 12, power from the ROV 29 latches the inner latching ring 38 into engagement with the wellhead 24 and riser 18 so as to connect each of these components end to end. The inner latching ring 38 is engaged and in contact with the riser 18 and wellhead 24 by applying hydraulic pressure through valve 52. The intermediate actuator ring 36 and inner latching ring 38 have cooperating tapered surfaces 51 and 53, respectively, which enable generally vertical or axial movement of the actuator ring to translate into generally radial movement of the inner latching ring. The ROV 29 supplies pressurized hydraulic fluid via valve 52 and fluid flow path 55 to a sealed chamber 57, disposed between the intermediate actuator ring 36 and the inner wall 34 of the main body 32. Chamber 57 is sealed on its top via seal 59 and on its bottom via seal 61 and 63. The hydraulic fluid pressure acts on intermediate actuator ring 36 thereby forcing said intermediate actuator ring 36 downward. The downward movement of the intermediate actuator ring 36 forces the inner latching ring 38 to move radially inward thereby engaging and latching the riser 18 to wellhead 24.

FIGS. 13 through 16 illustrate various embodiments of a connector positioner, which is part of the tieback connector 20 in accordance with the present invention. The positioner embodies an alternate means to fulfill the function of the gripping band 48 in FIG. 4. FIGS. 13A and 13B illustrate one embodiment of a connector positioner 54 in accordance with the present invention. The connector positioner 54 comprises a single ring-shaped gripping band 56 having a pair of opposed flanges, which is designed to be secured to the outer circumferential surface of the wellhead 24. Connector positioner 54 in this embodiment includes a single hydraulically operated cylinder 65 connected to the opposed flanges of the gripping band 56, which moves the gripping band into engagement with the outer circumferential surface of the wellhead 24. This hydraulic cylinder 65 is preferably operated by ROV 29. The ROV 29 positions the connector positioner 54 in the proper axial and circumferential alignment around the wellhead 24, activates the hydraulic cylinder 65 to secure the connector positioner 54 in place, thereby holding the tieback connector 20 in the appropriate orientation for receipt of the riser 18 upon landing.

Figure 14B:
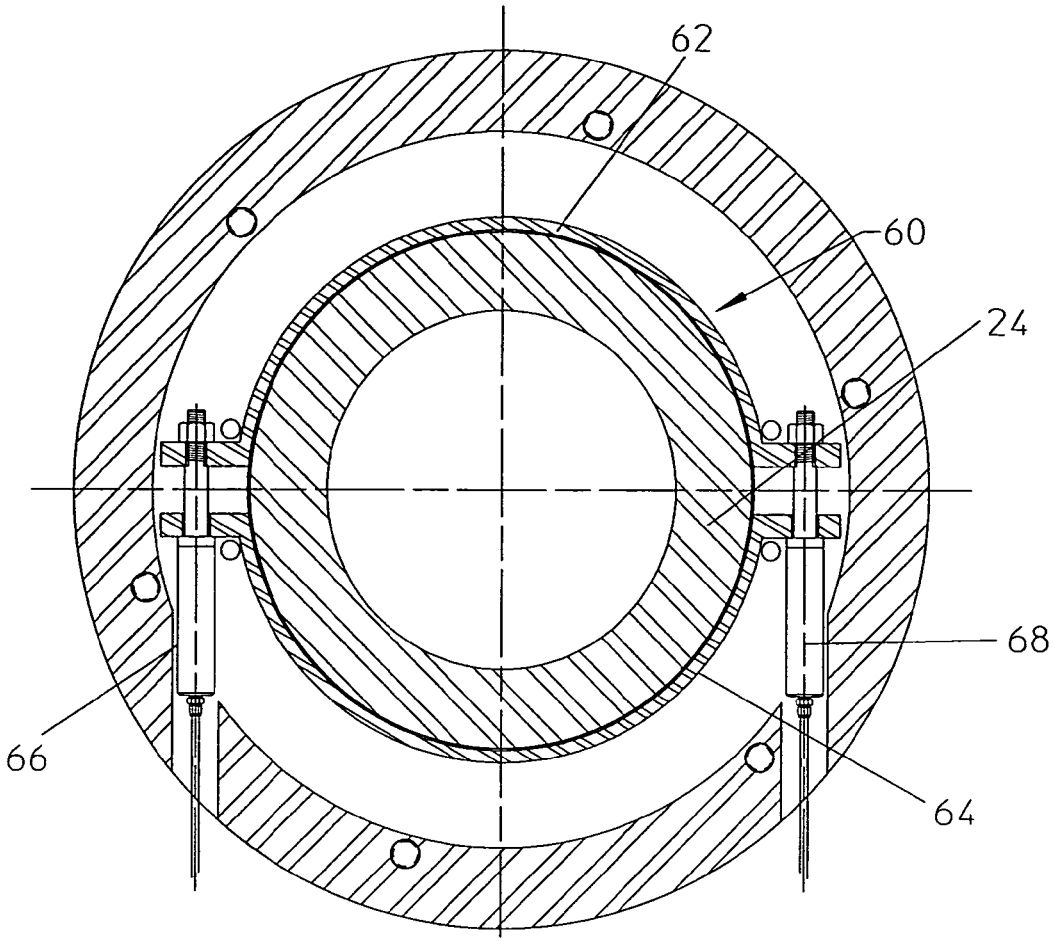
FIGS. 14A and 14B illustrate another embodiment of a connector positioner, which employs an ROV operated dual hydraulic cylinder gripping band.
Figure 14A:
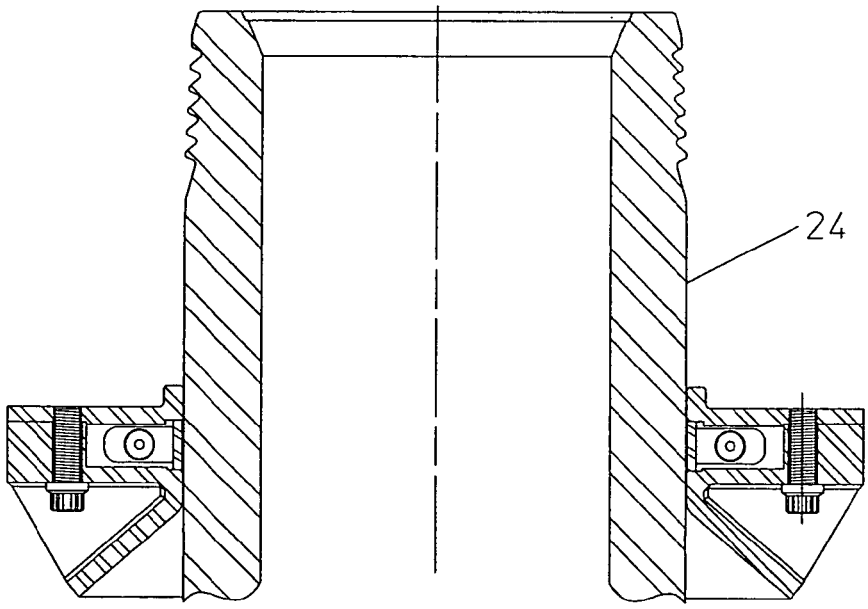

FIGS. 14A and 14B illustrate another embodiment of a connector positioner 58 for use with the tieback connector 20. Connector positioner 58 is similar to the connector positioner 54 in that it contains a gripping band 60. Gripping band 60 is comprised of two yoke sections 62 and 64. The yokes 62 and 64 have flanged ends placed in face-to-face relationship to one another and are secured around the outer circumferential surface of the wellhead 24 in place by a pair of hydraulic cylinders 66 and 68 connected to the flanged ends. The hydraulic cylinders 66 and 68 are operated by ROV 29.

Figure 15B:
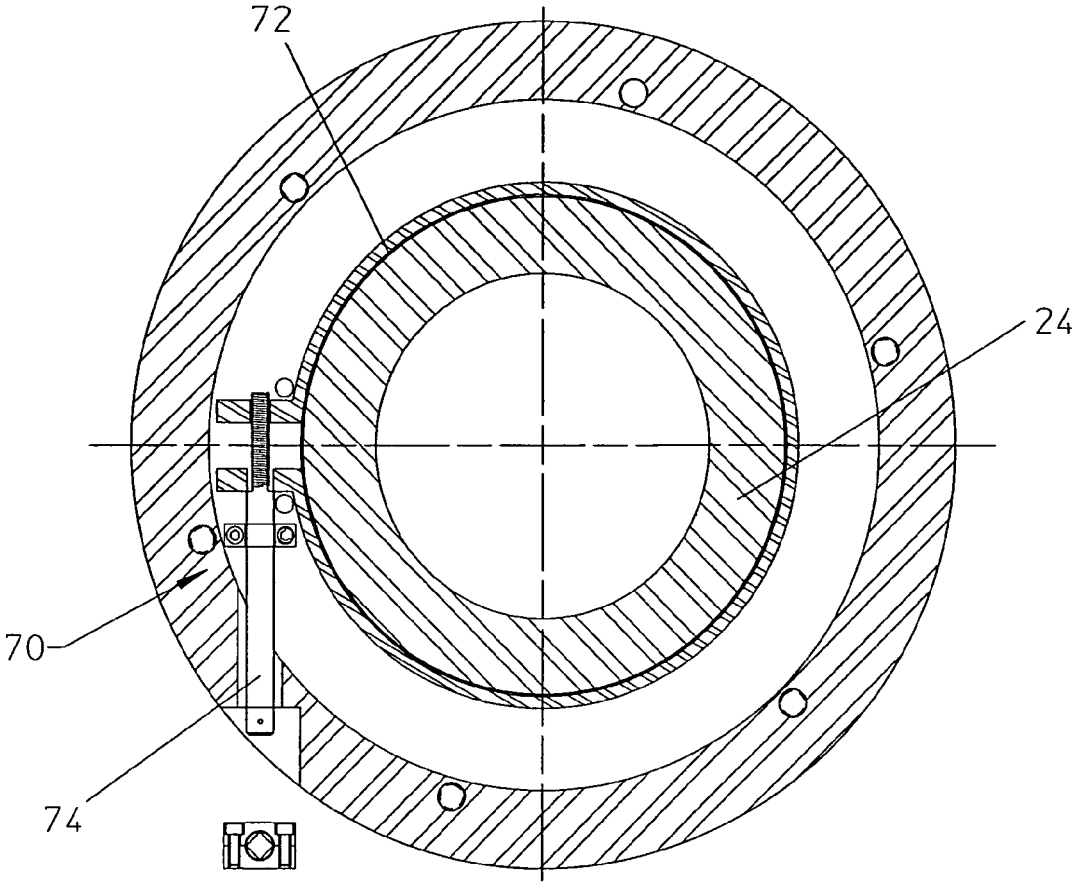
FIGS. 15A and 15B illustrate another embodiment of a connector positioner, which employs an ROV operated single mechanical cylinder gripping band.
Figure 15A:
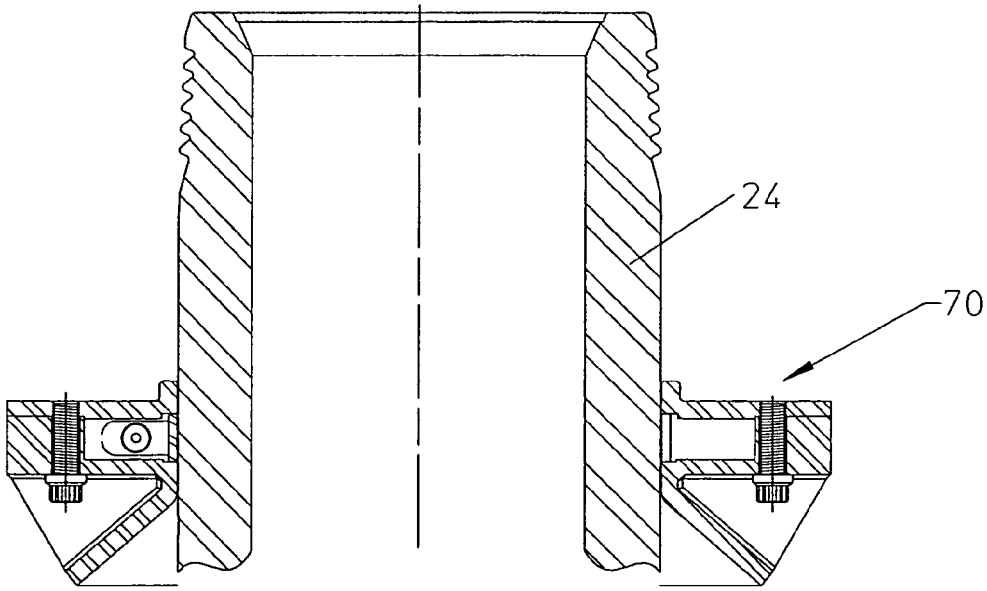

FIGS. 15A and 15B illustrate yet another embodiment of a connector positioner 70 used in connection with the tieback connector 20 in accordance with the present invention. The connector positioner 70 shown in FIGS. 15A and 15B comprises a single ring-shaped gripping band 72 having a pair of opposing flanges, which is cinched into place around the circumferential surface of the wellhead 24 by a single mechanically operated cylinder 74 threadedly attached to the opposing flanges. As those of ordinary skill in the art will recognize, the mechanical cylinder 74 can be operated by ROV 29.

Figure 16B:
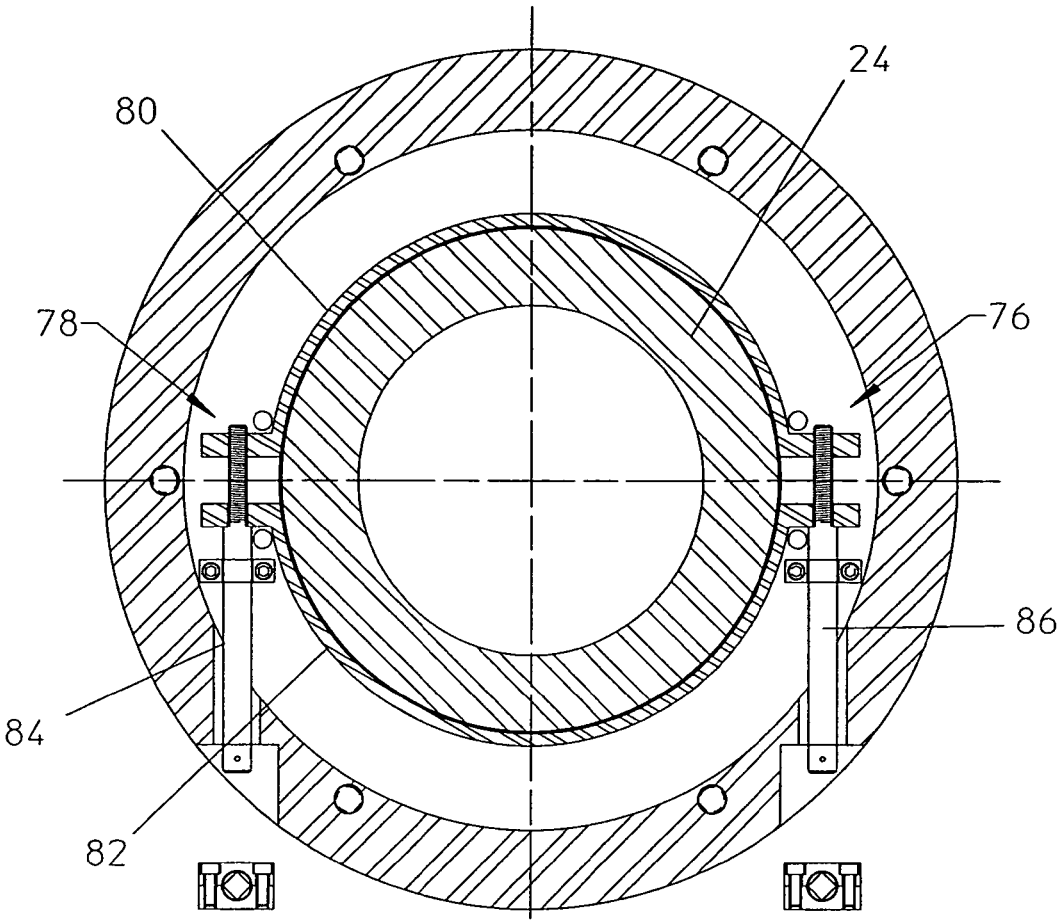
FIGS. 16A and 16B illustrate another embodiment of a connector positioner, which employs an ROV operated dual mechanical cylinder gripping band.
Figure 16A:
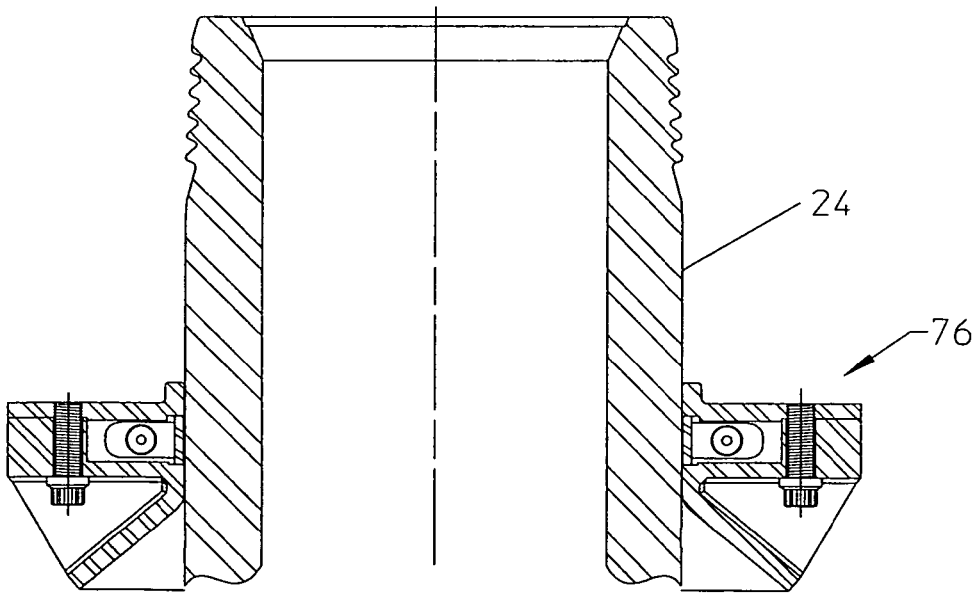

FIGS. 16A and 16B illustrate yet another embodiment of a connector positioner 76 used in connection with the tieback connector 20 in accordance with the present invention. Connector positioner 76 shown in FIGS. 16A and 16B comprises a gripping band 78 formed of two yokes 80 and 82 having flanged ends placed in face-to-face relationship to one another. The two yokes 80 and 82 are squeezed into engagement with the outer cylindrical surface of the wellhead 24 by a pair of mechanically operated cylinders 84 and 86 threadedly attached to the flanged ends. Mechanical cylinders 84 and 86 are operated by ROV 29.

Figure 17:
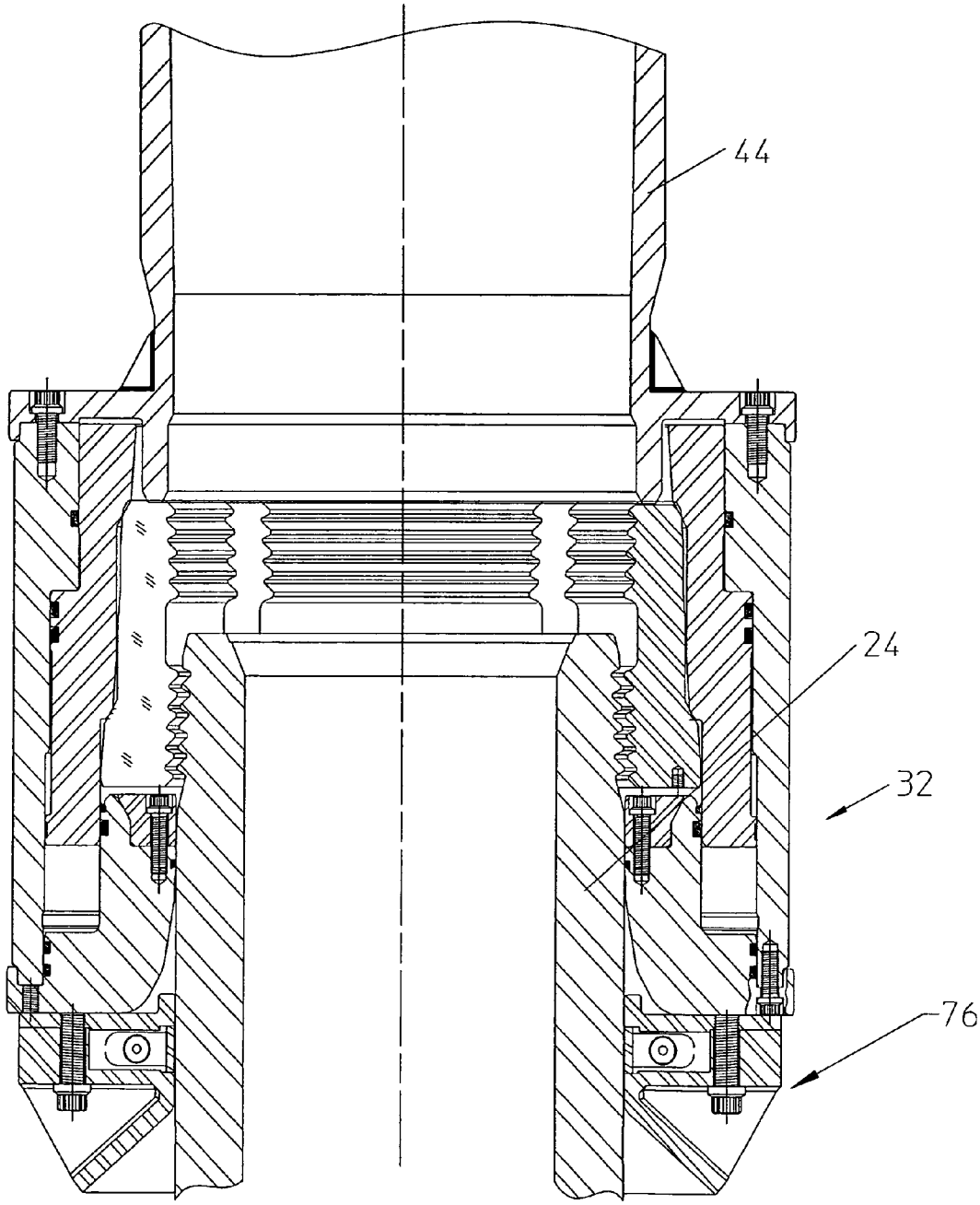
FIG. 17 illustrates one embodiment wherein the tieback connector is installed on the connector positioner, which is separate from the tieback connector.

In one embodiment in accordance with the present invention, the connector/positioner (e.g., connector/positioner 76) is a separate element from the main body 32 of tieback connector 20 and is secured to the wellhead 24 prior to installation of the main body 32 of tieback connector 20, as illustrated in FIG. 17.

Figure 18:
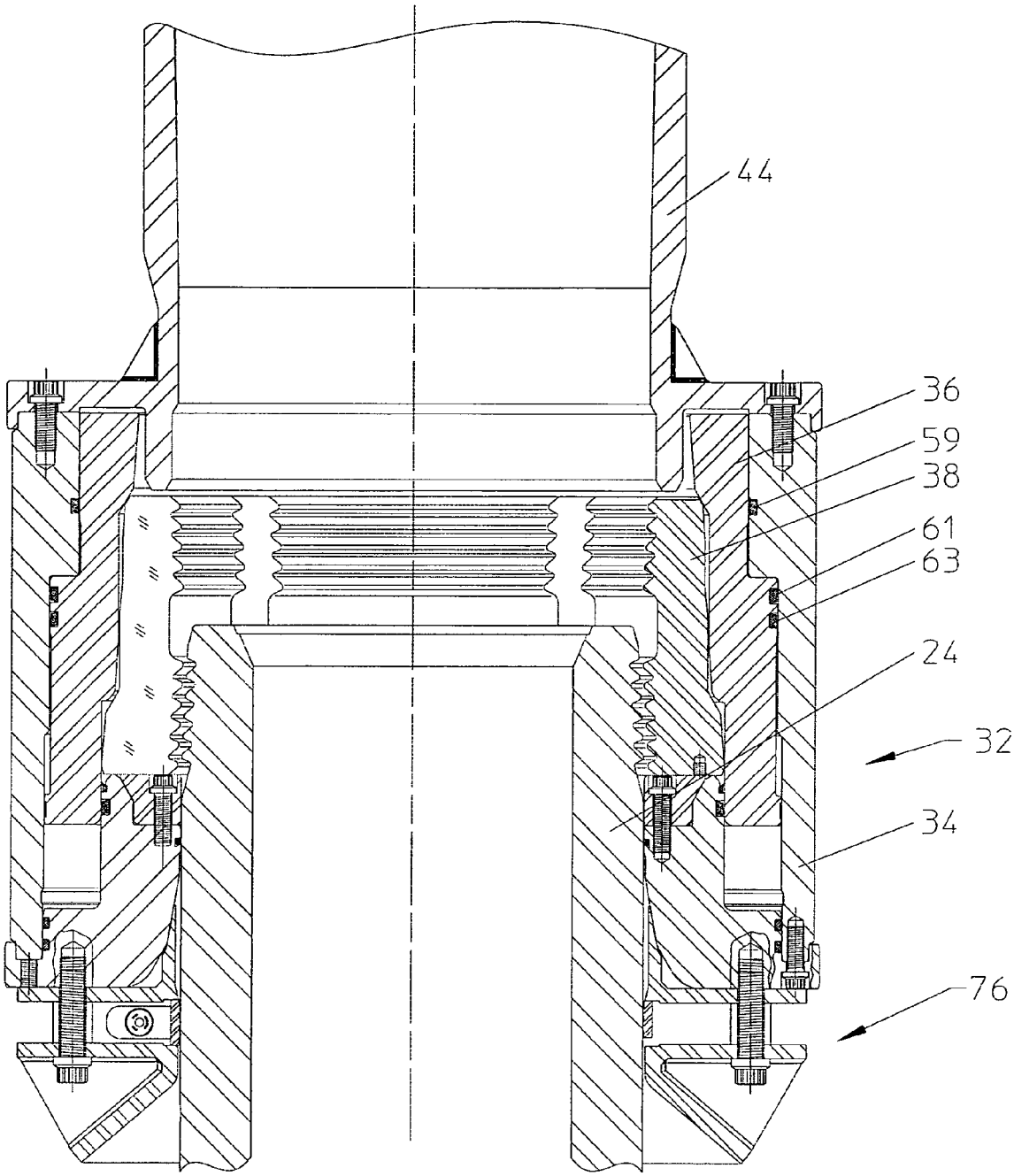
FIG. 18 illustrates another embodiment wherein the connector positioner is integrally formed with the tieback connector.

In yet another embodiment in accordance with the present invention, the connector positioner (e.g., connector positioner 76) is attached to or integrally formed with the main body 32 of the tieback connector 20, as illustrated in FIG. 18.

What is claimed is:

1. A system for attaching a riser string to a subsea wellhead, comprising:

the subsea wellhead;

the riser string, having an upper portion connected to a floating structure, and a terminus with a latching and sealing profile capable of engaging a tieback connector;

the tieback connector having a profile to receive and align the terminus of the riser string at the subsea wellhead; and an inner latching ring and an intermediate actuator ring disposed within the tieback connector, wherein the inner latching ring is disposed within the intermediate actuator ring, and wherein the inner latching ring has a plurality of grooves adapted to engage the subsea wellhead;

wherein the tieback connector is remotely installed around a circumferential surface of the subsea wellhead;

wherein the tieback connector is spaced vertically on the subsea wellhead;

wherein the riser string is attached to the tieback connector installed on the subsea wellhead;

wherein the tieback connector is installed on the subsea wellhead before the riser string is attached to the tieback connector; and wherein the tieback connector is installed on the subsea wellhead beneath the surface.

2. The system according to claim 1, wherein the tieback connector is adapted to be coupled to the subsea wellhead subsea by an ROV.

3. The system according to claim 1, further comprising an extension portion coupled to the tieback connector.

4. The system according to claim 3, wherein the extension portion is generally cylindrically-shaped and has an open end adapted to receive the terminus of the riser string during landing of the riser string on the subsea wellhead and a longitudinal profile adapted to correct any misalignment of the terminus of the riser string during landing of the riser string.

5. The system according to claim 4, wherein the profile of the extension portion is tapered along its length from a top end, which is defined by a generally funnel-shaped opening, to a bottom end which couples to the tieback connector.

6. The system according to claim 5, wherein the extension portion comprises an inwardly projecting rib formed adjacent to the funnel-shaped opening.

7. The system according to claim 1, wherein the intermediate actuator ring and the inner latching ring have cooperating tapered surfaces which enable generally axial or vertical movement of the actuator ring to translate into generally radial or transverse movement of the inner latching ring.

8. The system according to claim 7, further comprising a hydraulic pressure valve coupled to the tieback connector, which when activated supplies pressurized fluid to a sealed chamber disposed between the intermediate actuator ring and an inner wall of the tieback connector, wherein the pressurized fluid forces the intermediate actuator ring to move generally axially or vertically, which in turn causes the inner latching ring to move generally radially or transversely into engagement with the wellhead.

9. The system according to claim 1, wherein the inner latching ring comprises a plurality of annular segments.

10. The system according to claim 1, further comprising a connector positioner, which is adapted to secure the tieback connector around the circumferential surface of the wellhead; wherein the connector positioner comprises a single ring-shaped gripping band having opposed flanges, which fits around the circumferential surface of the wellhead.

11. The system according to claim 10, further comprising a hydraulic cylinder connected to the opposed flanges of the gripping band, which when activated in a retracted position causes the gripping band to grip the circumferential surface of the wellhead.

12. The system according to claim 10, further comprising a mechanically operated cylinder threadedly attached to the opposed flanges of the gripping band, which when tightened causes the band to grip the circumferential surface of the wellhead.

13. The system according to claim 1, further comprising a connector positioner, which is adapted to secure the tieback connector around the circumferential surface of the wellhead; wherein the connector positioner comprises a pair of yokes each having a pair of flanged ends, which are arranged around the circumferential surface of the wellhead such that the flanged ends face each other.

14. The system according to claim 13, further comprising a pair of hydraulic cylinders connected to the opposing flanged ends of the yokes, which when activated in a retracted position causes the yokes to grip the circumferential surface of the wellhead.

15. The system according to claim 13, further comprising a pair of mechanically operated cylinders threadedly attached to the opposing flanged ends of the yokes, which when tightened causes the yokes to grip the circumferential surface of the wellhead.

16. A method for attaching a riser string to a subsea wellhead, comprising:

providing the subsea wellhead;

providing the riser string, having an upper portion connected to a floating structure, and a terminus with a latching and sealing profile capable of engaging a tieback connector;

providing the tieback connector having a profile to receive and align the terminus of the riser string at the subsea wellhead;

providing an inner latching ring and an intermediate actuator ring disposed within the tieback connector, wherein the inner latching ring is disposed within the intermediate actuator ring, and wherein the inner latching ring has a plurality of grooves adapted to engage the subsea wellhead;

remotely installing the tieback connector around a circumferential surface of the subsea wellhead;

spacing the tieback connector vertically on the subsea wellhead; and attaching the riser string to the tieback connector installed on the subsea wellhead;

wherein the tieback connector is installed on the subsea wellhead before the riser string is attached to the tieback connector; and wherein the tieback connector is installed on the subsea wellhead beneath the surface.

17. The method according to claim 16, wherein the step of remotely installing the tieback connector on the subsea wellhead is performed subsea by an ROV.

18. The method according to claim 16, wherein the step of spacing the tieback connector vertically on the subsea wellhead comprises using a tieback positioner comprising a single ring-shaped gripping band having opposed flanges, which fits around the circumferential surface of the wellhead.

19. The method according to claim 18, wherein the step of spacing the tieback connector vertically on the subsea wellhead further comprises using a hydraulic cylinder connected to the opposed flanges of the gripping band, which when activated in a retracted position causes the gripping band to grip the circumferential surface of the wellhead.

20. The method according to claim 18, wherein the step of spacing the tieback connector vertically on the subsea wellhead further comprises using a mechanically operated cylinder threadedly attached to the opposed flanges of the gripping band, which when tightened causes the band to grip the circumferential surface of the wellhead.

21. The method according to claim 16, wherein the step of spacing the tieback connector vertically on the subsea wellhead comprises using a tieback positioner comprising a pair of yokes each having a pair of flanged ends, which are arranged around the circumferential surface of the wellhead such that the flanged ends face each other.

22. The method according to claim 21, wherein the step of spacing the tieback connector vertically on the subsea wellhead further comprises using a pair of hydraulic cylinders connected to the opposing flanged ends of the yokes, which when activated in a retracted position causes the yokes to grip the circumferential surface of the wellhead.

23. The method according to claim 21, wherein the step of spacing the tieback connector vertically on the subsea wellhead further comprises using a pair of mechanically operated cylinders threadedly attached to the opposing flanged ends of the yokes, which when tightened causes the yokes to grip the circumferential surface of the wellhead.

24. The system according to claim 1, wherein the plurality of grooves of the inner latching ring are also adapted to engage the riser string terminus, wherein the intermediate actuator ring and the inner latching ring have cooperating tapered surfaces which enable generally axial or vertical movement of the actuator ring to translate into generally radial or transverse movement of the inner latching ring, and wherein transverse movement of the inner latching ring causes the inner latching ring to simultaneously engage both the subsea wellhead and the riser string terminus and cause the riser string terminus to be connected directly to and seal directly to the subsea wellhead.

25. The method according to claim 16, wherein the plurality of grooves of the inner latching ring are also adapted to engage the riser string terminus, wherein the intermediate actuator ring and the inner latching ring have cooperating tapered surfaces which enable generally axial or vertical movement of the actuator ring to translate into generally radial or transverse movement of the inner latching ring, and wherein transverse movement of the inner latching ring causes the inner latching ring to simultaneously engage both the subsea wellhead and the riser string terminus and cause the riser string terminus to be connected directly to and seal directly to the subsea wellhead.

* * * * *